US005787539A

United States Patent [19]

Nussbaum

[11] Patent Number: 5,787,539

[45] Date of Patent: Aug. 4, 1998

[54] GOLF CLUB CLEANER

[76] Inventor: Steven Nussbaum, 617 Water Oak Dr., Plano, Tex. 75025

[21] Appl. No.: 800,805

[22] Filed: Feb. 18, 1997

[51] Int. Cl.[6] ..... A46B 13/04

[52] U.S. Cl. ..... 15/24; 15/29

[58] Field of Search ..... 15/24, 29

[56] References Cited

U.S. PATENT DOCUMENTS

| | | | |
|---|---|---|---|
| 2,740,977 | 4/1956 | Allen | 15/24 |
| 3,235,897 | 2/1966 | Fortenberry | 15/24 |
| 3,293,678 | 12/1966 | South | 15/29 |
| 3,396,417 | 8/1968 | Starr | 15/29 |
| 3,443,272 | 5/1969 | Trelc et al. | 15/29 |
| 3,892,004 | 7/1975 | Downes | 15/24 X |
| 3,943,591 | 3/1976 | Lanussé | 15/29 |
| 4,168,560 | 9/1979 | Doyel | 15/29 |
| 5,423,102 | 6/1995 | Madison | 15/29 X |

FOREIGN PATENT DOCUMENTS

| | | | |
|---|---|---|---|
| 3308134 | 9/1984 | German Dem. Rep. | 15/29 |
| 797432 | 7/1958 | United Kingdom | 15/24 |

*Primary Examiner*—Mark Spisich
*Attorney, Agent, or Firm*—John E. Vandigriff

[57] ABSTRACT

The invention is a hand held golf club cleaner that utilizes a common plunger to apply power to a motor that rotates a cleaning brush, and to pump a cleaning fluid from a reservoir inside the golf club cleaner onto the golf club head. A set of gears reduces the speed of brush rotation from the speed of the motor to provide greater brush rotational torque.

9 Claims, 4 Drawing Sheets

GOLF CLUB CLEANER

FIELD OF THE INVENTION

The invention relates to golf club cleaners, and more particularly to a hand held golf club cleaner that utilizes a single push button to apply a liquid spray and actuate a motor driven cleaning brush.

BACKGROUND OF THE INVENTION

Golfers play golf under many conditions which soil the golf club. These conditions may include wet surfaces, on grass, and non-grass areas. When the golf ball is hit from these areas, or ever from the fairway where "divots" occur, the golf ball, as well as the golf club, is soiled. A dirty golf club may prevent accurate driving of the ball due to a build-up of dirt and grass on the gold club. To overcome this problem, golf clubs may need to be cleaned several times during a game.

U.S. Pat. No. 5,235,716 describes a golf club cleaning device which is essentially a hand held electric motor with interchangeable brushes. With the described device, any debris on the golf club is removed by brushing it with the rotating brush.

U.S. Pat. No. 4,940,349 describes a cleaning brush in a frame with brush bristles being internal to the frame. A pump and water reservoir in the handle is used to spray cleaning fluid on the golf club prior to inserting the golf club through the frame and bristles.

U.S. Pat. No. 4,872,232 describes a portable golf club head cleaner, but it is not hand held.

Similarly, U.S. Pat. N. 4,472,851 describes a golf club cleaner that is not hand held and is connected to a water faucet.

SUMMARY OF THE INVENTION

The invention is a hand held golf club cleaner that utilizes a common plunger to apply power to a motor that rotates a cleaning brush, and to pump a cleaning fluid from a reservoir inside the golf club cleaner onto the golf club head. A set of gears reduces the speed of brush rotation from the speed of the motor to provide greater brush rotational torque. The brush is removed so that various brushes may be used. The golf club cleaner housing is configured to be held in one hand and the common plunger pressed downward as needed by the thumb to apply cleaning fluid to the golf club head and apply power to the motor which rotates the cleaning brush.

The technical advance represented by the invention as well as the objects thereof will become apparent from the following description of a preferred embodiment of the invention when considered in conjunction with the accompanying drawings, and the novel features set forth in the appended claims.

DESCRIPTION OF A PREFERRED EMBODIMENT

Figure 1:
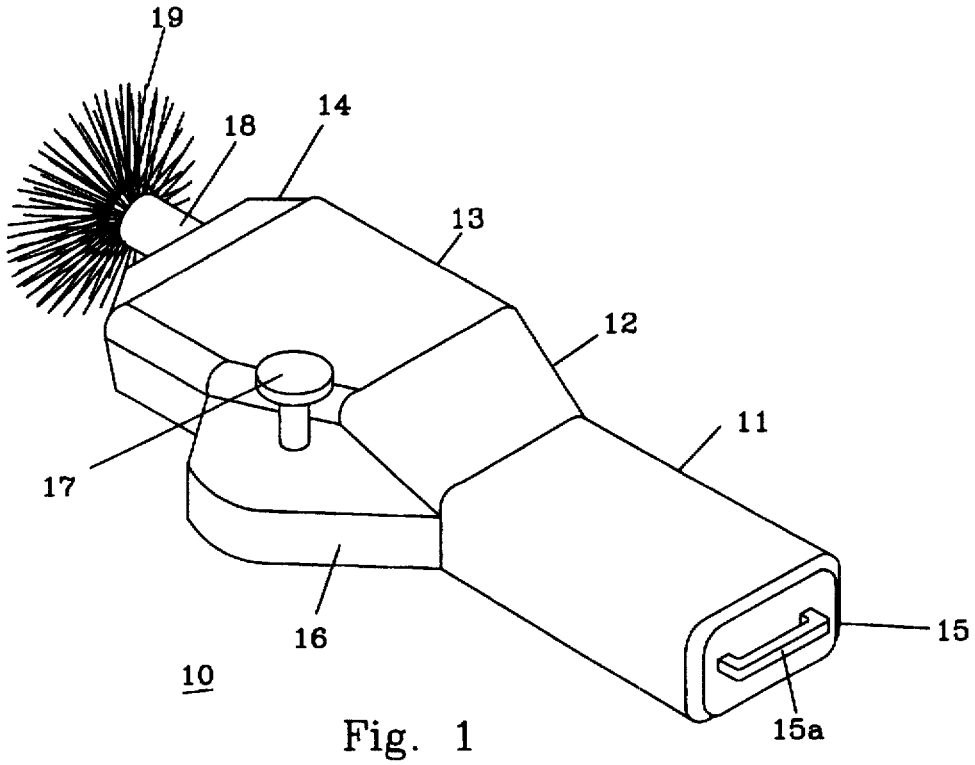
FIG. 1 is an isometric drawing of the golf club cleaner device of the present invention.

The invention is a hand held golf club cleaner device as shown, for example, in FIG. 1. Golf club cleaner 10 includes a body made up of handle 11, with grips **11*d*, which is attached to a transition region 12 and a main body 13 which includes a motor, gearing assembly and a cleaning fluid reservoir (illustrated in FIG. 5). Main body 13 has a tapered end 14 which terminates at a flat end through which drive shaft 18 extends. Brush 19 is mounted on the end of shaft 18. Extending out from transition region 12 and main body 13 is a projecting body part 16 which has mounted thereon plunger/switch 17. Body part 16 houses a part of the fluid reservoir and a pump and switch mechanism (shown in FIG. 5) which pumps cleaning fluid, and activates a motor for rotating brush 19. Handle 11** houses batteries for powering the brush motor.

Figure 2:
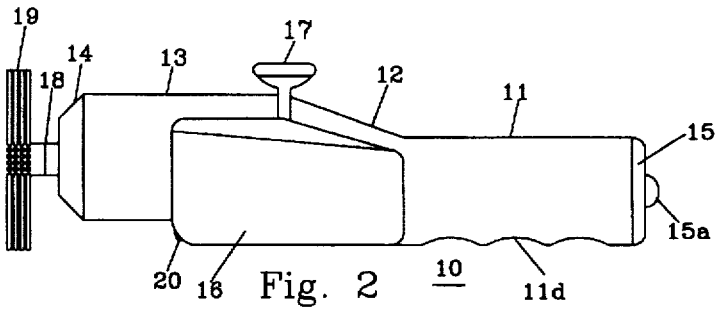
FIG. 2 is a side view of the golf club cleaner device.

FIG. 2 is a side view of golf club cleaner 10 showing handle 11 with end cap 15, which is removable for inserting batteries into handle 11. End cap 15 may include a bar **15*a* which allows the cleaner to be attached to a clip or other device allowing it to be secured to a belt or golf bag. Transition region 12 tapers upward to the top of main body 13, but joins the bottom portion of handle 11 to main body 13. Projecting body part 16 is shown with plunger/switch extending out of the upper surface of body 16. At the end of body part 16 is an outlet jet 20 through which cleaning fluid is pumped onto a golf club, not illustrated. Shaft 18 turns brush 19**.

Figure 3:
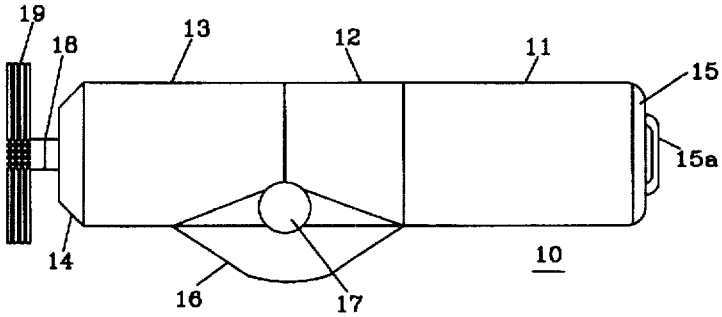
FIG. 3 is a top view of the golf club cleaner device.

FIG. 3 is a top view of golf club cleaner 10 showing the top views of body parts 11, 12 and 13. Projecting part 16 extends out the side of main body 13 and transition part 12. The outer edge of part 16 is rounded, as are all edges of body parts 11, 12 and 13 so that there are no sharp corners that are uncomfortable to the hand when holding the golf club cleaner. Plunger/switch 17 is spaced from the outer edge of part 16 so that a user's thumb is placed over plunger 17 when the golf club cleaner is held in the right hand. Both an internal pump and motor switch is actuated, as described below, as plunger 17 is pressed downward.

Figure 4:
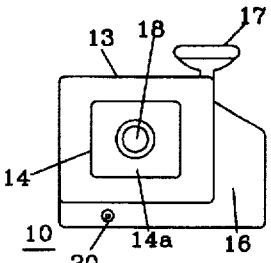
FIG. 4 is an end view of the golf club cleaner device.

FIG. 4 is an end view of the golf club cleaner showing that the tapered portion 14 of main body 13 terminates in a rectangular end **14*a* with brush shaft 18 extending out of the rectangular end. Brush 19 has been removed to clearly show end 14*a* and outlet jet 20**.

Figure 5:
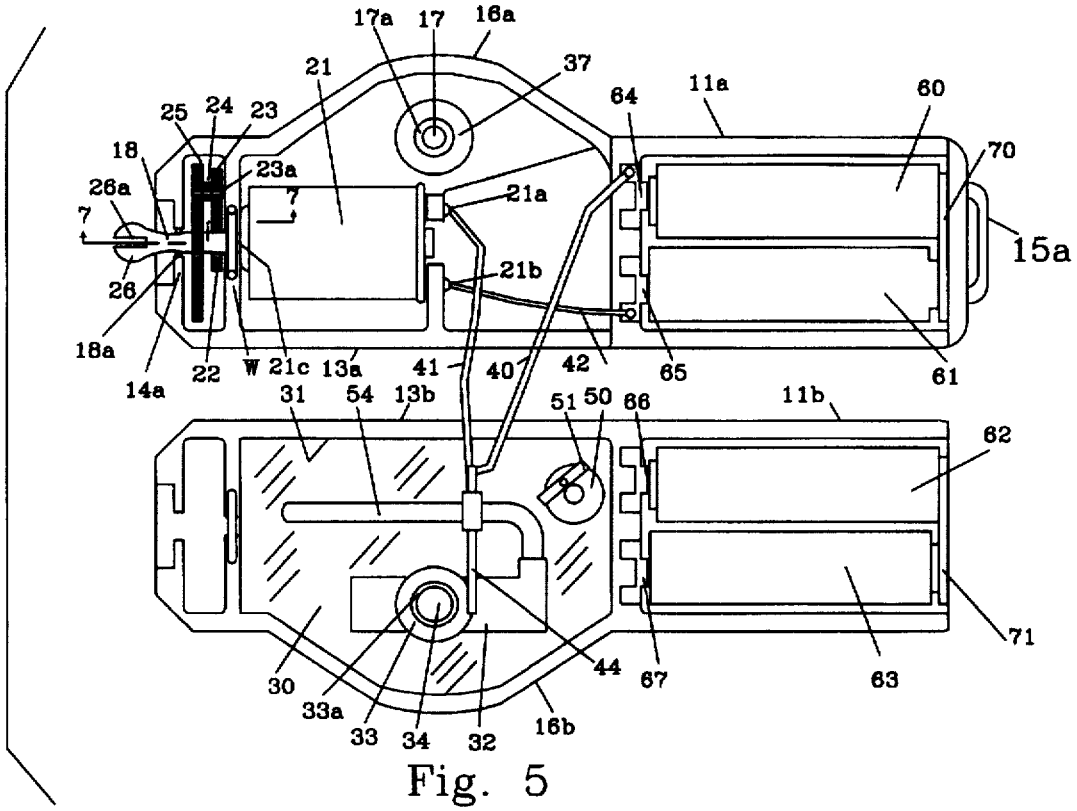
FIG. 5 is an internal view of the two sides of the golf club cleaner device.

FIG. 5 shows the golf club cleaner open with the insides of bottom part **13*b* and top part 13*a* facing up, exposing the internal components of the cleaner. Cleaner 10 has two sides 11*a* and 11*b*. Side 11*a* has mounted therein a motor 21 with a shaft 21*c* which rotates gear 22. Gear 22 (removed in FIG. 7 to show gear 23)in turn rotates gear 23 which is rotatably mounted on internal wall W. Attached to and integral with gear 23 is gear 24 that rotates with gear 23 and turns gear 25. Gear 25 is mounted in end 14*a* and extends through a seal 18*a* to wall W, in which it is rotatably mounted. Seal 18*a* prevents water from entering into the cleaner housing, keeping water away from motor 21**.

Motor 21 is connected to batteries 60–63, which provide power to motor 21 via contacts 64–67 and 70 and 71. Motor 21 is connected to the batteries through wires 40, 41 and 42, wherein wires 41 and 42 are connected to motor 21 terminals **21*a* and 21*b***.

A portion of side **11*b*, basically main body 13*b* and part 16*b*, is enclosed with plate 30 which provides reservoir 31** for holding cleaning fluid, for example, water. Inside of reservoir 31 is a pump 32 which has an actuator 34, which when pushed downward by plunger 17, forces water out of pump 32 through line 54 to outlet jet 20 (FIG. 2). When plunger 17 is released, water is drawn out of reservoir 31 into pump 32. Pump 32 is mounted on plate 30 by ring 33 through which plunger 17 extends to actuator 34. Pump 32 is any simple fluid pump that forces water out of the pump when a plunger is pressed against actuator 34, and draws water into the pump when actuator is allowed to move upward, usually by a spring (not illustrated) or a flexible diaphragm in the pump. Examples of such pumps are found in water guns and liquid dispensing bottles that have a hand actuated pump to pump liquids such as window cleaner or soap.

Plug 50, in the bottom of side **13*b*, is removable for filling reservoir 31 with a cleaning fluid. Retainer 51, attached to plug 50 prevents plug 50 from being separated from bottom 13*b***.

Figure 6:
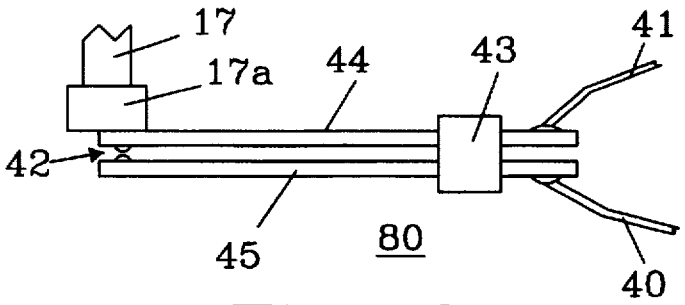
FIG. 6 shows the ON-OFF switch for the brush drive motor.

Also attached to plate 30 is leaf switch 80. Leaf switch 80 is actuated when plunger 17 is pressed downward. FIG. 6 show leaf switch 80 and its components. Two leaf springs 44 and 45 are held apart by insulator 43 on one end and have contacts 42 on the other end. As plunger 17 is moved downward, shoulder **17*a* moves leaf spring 44 downward closing contact 42, and closing the circuit to provide power to motor 21. Switch leaf 45 is connected to positive terminal 64 by wire 40, and leaf 44 is connected to terminal 21*a* on motor 21 by wire 41**.

When the two parts **11*a* and 11*b* of the golf club cleaner are joined together, plunger 17 is placed into opening 33*a* against actuator 34. When plunger 17 is pressed downward, forcing pump actuator 34 into pump 32, water or cleaning fluid is forced out of pump 32, through line 54 to outlet jet 20. Also when plunger 17 is pressed downward, contacts 42 are closed, applying power to motor 21 which in turn rotates brush 19. As long as plunger is held down, brush 19 will rotate. If additional cleaning fluid is needed, then plunger 17 can be pushed down and released several times to pump cleaning fluid out outlet jet 20 on a golf club, then plunger is held down to cause motor 21 and brush 19** to rotate.

Figure 7:
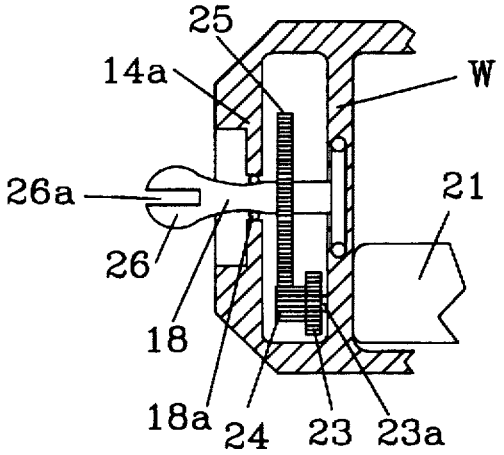
FIG. 7 is a cross-sectional view of the gear mechanism of the golf club cleaner device.

FIG. 7 is a partial view, in cross-section, section 7—7 of FIG. 5, of the end 14 to show a side view of the gears. Motor 21 drives gear 22 via shaft **21*c* (FIG. 5). Gear 23, which is attached to shaft 23*a* turns when gear 22 turns. Gear 24, which is a part of gear 23, and on the same shaft, meshes with gear 25 which turns brush shaft 18. Brush 19 (not shown in FIG. 7) snaps onto end 26 of shaft 18. Slot 26*a* mates with a corresponding part (not illustrated) in brush 19 to prevent brush 19 from rotating on shaft 18**.

What is claimed:

1. A hand held golf club cleaner, comprising:

a housing having first and second halves, each half having adjacent first and second ends;

a motor mounted in said first half;

a gear train including a plurality of gears and a drive shaft, said drive shaft connected to one of said gears and extending out of an opening in the first ends of said first and second halves;

a removable rotatable brush connected to said drive shaft;

a liquid reservoir in said second half, said reservoir formed by an outer wall of said second half, a pair of inner walls and a plate secured to said outer wall and said inner walls;

a pump mounted in said reservoir for pumping liquid from said reservoir;

an outlet jet extending out of said first end of said second half through which liquid is pumped out of said reservoir; and a combination plunger/switch actuator for pumping fluid out of said reservoir and applying power to said motor.

2. The golf club cleaner according to claim 1, wherein said gear train reduces the speed of rotation of the brush from the rotation speed of the motor.

3. The golf club cleaner according to claim 1, including a closeable inlet in said second half for filling the liquid reservoir.

4. The golf club cleaner according to claim 1, wherein the plunger/switch actuator is spring biased upward so that it must be held down by a user to maintain power to the motor.

5. The golf club cleaner according to claim 1, including a battery cavity formed in said first and second halves at said second end, and a removable cover at said second end to provide access to the battery cavity.

6. A hand held gold club cleaner, comprising:

a housing having first and second halves, each half having adjacent first and second ends;

a motor mounted in said first half;

a gear train including a plurality of gears and a drive shaft, said drive shaft connected to one of said gears and extending out of an opening in the first ends of said first and second halves;

a removable rotatable brush connected to said drive shaft;

a liquid reservoir in said second half, said reservoir formed by an outer wall of said second half, a pair of inner walls and a plate secured to said outer wall and said inner walls;

a pump mounted in said reservoir for pumping liquid from said reservoir;

an outlet jet extending out of said first end of said second half through which liquid is pumped out of said reservoir; and a combination plunger/switch actuator for pumping fluid out of said reservoir and applying power to said motor, wherein the plunger/switch actuator is spring biased upward so that it must be held down by a user to maintain power to the motor.

7. The golf club cleaner according to claim 6, wherein said gear train reduces the speed of rotation of the brush from the rotation speed of the motor.

8. The golf club cleaner according to claim 6, including a closeable inlet in said second half for filling the liquid reservoir.

9. The golf club cleaner according to claim 6, wherein said outlet jet is adjacent said brush.

* * * * *